United States Patent [19]

DuBuque

[11] Patent Number: 4,675,996

[45] Date of Patent: Jun. 30, 1987

[54] BOX KNIFE

[76] Inventor: Thomas DuBuque, 1301 Westview Dr. - Apt. 22, Fulton, Mo. 65251

[21] Appl. No.: 850,485

[22] Filed: Apr. 11, 1986

[51] Int. Cl.[4] ..... B67B 7/00

[52] U.S. Cl. ..... 30/2; 30/151

[58] Field of Search ..... 30/2, 151, 286, 287, 30/295, 329, 335

[56] References Cited

U.S. PATENT DOCUMENTS

| | | | |
|---|---|---|---|
| 2,695,447 | 11/1954 | Maynard | 30/2 |
| 2,730,800 | 1/1956 | Bailey | 30/2 |
| 3,406,447 | 10/1968 | Travlos | 30/2 |
| 3,781,988 | 1/1974 | Jones | 30/2 |

*Primary Examiner*—Douglas D. Watts

*Attorney, Agent, or Firm*—Gravely, Lieder & Woodruff

[57] ABSTRACT

A box knife has a handle and a blade that is carried in the handle such that a segment of the blade projects beyond one end of the handle. In addition, the handle has two guards which are hinged to it remote from the cutting edge of the blade, and these guards are capable of moving between an extended position and retracted positions, yet are spring biased to the extended position so they assume that position when the knife is not in use. When in the extended position, the guards lie to the sides of the blade to shield it and the cutting edge on it, but when the guards are in their retracted position the blade is exposed. Moreover, the guards have curved leading and lower edges so that when the knife is brought against sheet material that is to be slit, the guards merely roll along that surface of that material and allow the blade to penetrate the material.

19 Claims, 6 Drawing Figures

BOX KNIFE

BACKGROUND OF THE INVENTION

This invention relates in general to knives, and more particularly to a knife which is particularly suited for slitting sheet material, such as corrugated paperboard.

Many of the goods sold in this country are shipped in boxes constructed from paperboard, usually corrugated paperboard, and this not only holds true with regard to individually packaged items, but bulk items as well. Indeed, employees of retail stores spend considerable time merely opening corrugated paperboard boxes and unpacking the contents for display in such stores. Special box knives exist for this purpose.

The typical box knife consists of nothing more than a handle which contains a retractable blade holder or carrier, and the blade carrier, as its name implies, holds a blade. When the carrier is extended it projects the blade beyond the end of the handle where its cutting edge is exposed more or less as an extension of the lower surface of the handle. To use the knife to open a corrugated paperboard box, one merely grasps the knife handle and runs the cutting edge of the blade along walls of the box, urging the handle inwardly with enough force to enable the blade to penetrate and actually slit the box.

While the blade of the typical box knife retracts, users on many occasions do not make the effort to retract it prior to setting the knife aside, so the knife with its exposed cutting edge presents a danger to those who may come against it. An even greater danger exists when the knife is in use, for its blade must be forced along the wall of the box against appreciable resistance, but once the blade clears the end of the box, the resistance terminates, and if the user does not exercise caution, the knife with its exposed blade could cut the user or someone nearby. In this regard, the usual practice is to draw the knife toward one's self when opening a box, and an overdraw of the knife could seriously cut the user once the blade clears the end of the box. Indeed, flesh cuts caused by overly aggressive and perhaps inattentive opening of paperboard boxes are not uncommon, particularly at retail stores.

SUMMARY OF THE INVENTION

One of the principal objects of the present invention is to provide a knife which is suitable for slitting corrugated paperboard and other sheet material, yet is quite safe to use. Another object is to provide a knife of the type stated having guards which spring out to shield the blade the instant the blade comes out of a slit or other cut along which it is advanced. A further object is to provide a knife of the type stated having guards which easily retract and do not interfere with the insertion of the knife blade into corrugated paperboard or other material. An additional object is to provide a knife of the type stated in which the guards are pivoted on the knife handle and have curved leading and lower edges so as to roll along the sheet material to be cut as the knife blade penetrates that material. Still another object is to provide a knife of the type stated which is simple and durable in construction and economical to manufacture. Yet another object is to provide an adapter for providing a conventional box knife with guards of the type described. These and other objects and advantages will become apparent hereinafter.

DESCRIPTION OF THE DRAWINGS

In the accompanying drawings which form part of the specification and wherein like numerals and letters refer to like parts wherever they occur —

DETAILED DESCRIPTION

Figure 1:
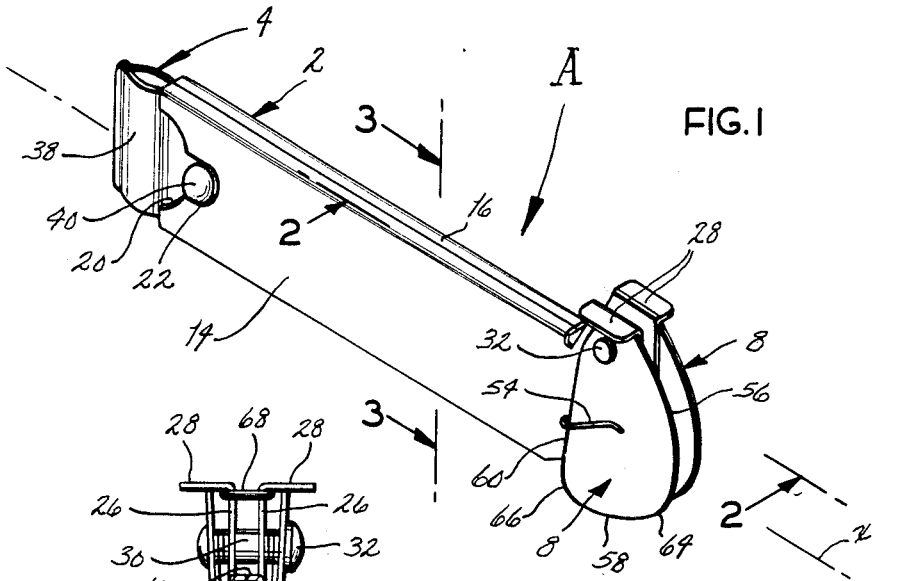
FIG. 1 is a perspective view of a box knife constructed in accordance with and embodying the present invention.
Figure 3:
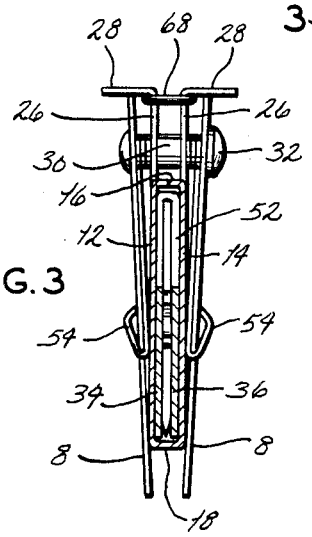
FIG. 3 is a sectional view taken along line 3—3 of FIG. 1.

Referring now to the drawings, a box knife A (FIGS. 1–5) is designed for cutting corrugated paperboard and other sheet material and hence is ideally suited for slitting the walls of corrugated paperboard boxes so as to open such boxes. Unlike traditional box knives with their exposed blades, the blade of the knife A is covered the instant it is withdrawn from a cut, so it is less likely to inflict injury when inattentively used or left unprotected. Basically, the knife A comprises four components, namely a handle 2, a blade holder or carrier 4 which fits into the handle 2, a blade 6 which is retained in the blade carrier 4, and spring loaded guards 8 which are attached to the handle and shield the blade 6 when the blade 6 is not in use.

The handle 2 is quite thin, yet hollow, and has a longitudinal axis x. It consists of a flat side wall 12, a slightly depressed side wall 14 and upper and lower edge walls 16 and 18 which extend between the upper and lower margins respectively of the two side walls 16 and 18—but all of the walls 12, 14, 16, and 18 are parallel to the longitudinal axis x. At the rear of the handle 2, the two side walls 12 and 14 are cut away to provide an arcuate cutout 20 (FIGS. 1 & 4), and in addition, the depressed side wall 14 is further cut away to provide another, although smaller, cutout 22 which is generally semicircular in shape and opens into the larger cutout 20 for that wall. The lower edge wall 18 terminates short of the opposite end of the handle 2 and here the two side walls 12 and 14 have oblique edges 24 which lead out to the very front of the handle 2. Indeed, the interior of the handle 2 is exposed at the front of the handle 2 and also along the oblique edges 24. Also at the front of the handle 2, the two side walls 12 and 14 merge into pivot tabs 26 which project upwardly above the upper edge wall 16 and at their upper ends are provided with outwardly directed stop flanges 28. The spacing between the two tabs 26 equals or is slightly greater than the spacing between the two side walls 12 and 14, and indeed the tabs 26 are separated by a collar 30 (FIG. 3) which maintains the appropriate spacing. The collar 30 as well as the tabs 26 at each end of it receive a pivot pin 32 which further projects slightly beyond each of the two tabs 26 to provide journals on which the blade guards 8 pivot.

The blade carrier 4 fits snugly into the hollow interior of the handle 2 and consists of two side walls 34, 36 both of which extend the full length of the carrier 4 and are compressed between the two side walls 12 and 14 of the carrier 4. In this regard, the side wall 36 midway between its ends bulges slightly away from the side wall 34 and the spacing between the flat side wall 12 and the depressed side wall 14 in the depressed region of the latter is perhaps somewhat less than the thickness of the carrier 4 at the bulge in it, so that the depressed portion of the handle side wall 14 urges the carrier 4 against the flat handle side wall 12. As a consequence, the carrier 4, while being free to slide into and out of the handle 2, is nevertheless held with a considerable amount of friction at any position to which it is moved. The depressed configuration of the handle side wall 14 enables it to yield or spring outwardly to accommodate variances in the thickness of blade carrier 4, yet maintain a firm frictional grip on the carrier 4.

When the carrier 4 is inserted properly into the handle 2 (FIGS. 1-3), the side wall 34 of the carrier 4 is presented toward the flat side wall 12 of the handle 2, whereas the other side wall 36 of the carrier 4 is presented toward the depressed side wall 14 of the handle 2, so it is the bulging portion of the carrier side wall 34 against which the depressed midportion of the handle wall 14 bears. The carrier 8 is moreover somewhat longer than the handle 2, and at its rear each of its walls 34 and 36 flares somewhat outwardly to provide a grip 38 which is too thick to fit into the interior of the handle 2, yet the grip 38 along its front surfaces is accessible from the arcuate cutouts 20 in the two side walls 12 and 14 of the handle 2. Indeed, to withdraw the carrier 4 from the handle 2, one merely places one's thumb and forefinger in the arcuate cutouts 20 of the opposite side walls 12 and 14, squeezes to obtain a good grip on the carrier 4 at the grip 38, and then pulls the carrier 4 out of the handle 2. In addition to the grip 38, the carrier 4 at its rear has a generally cylindrical boss 40 which protrudes from the exposed surface of its side wall 36 and exists in the exposed surface of the other side wall 34 as a dimple. The boss 40 aligns with and is sized to fit into the smaller of the two arcuate cutouts 22 in the depressed wall 14 of the handle 2. Indeed, when the carrier 4 is fully inserted into the handle 2, the boss 40 fits into the smaller cutout 22 in the depressed wall 14 of the handle 2 and serves to locate the carrier 4 in the proper position longitudinally with respect to the handle 2.

Figure 2:
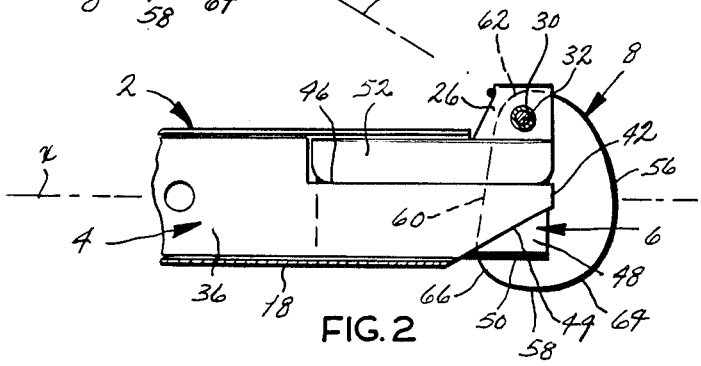
FIG. 2 is a fragmentary sectional view of the box knife taken along line 2—2 of FIG. 1 and showing the blade projected outwardly at the end of the handle, yet protected by one of the guards.
Figure 4:
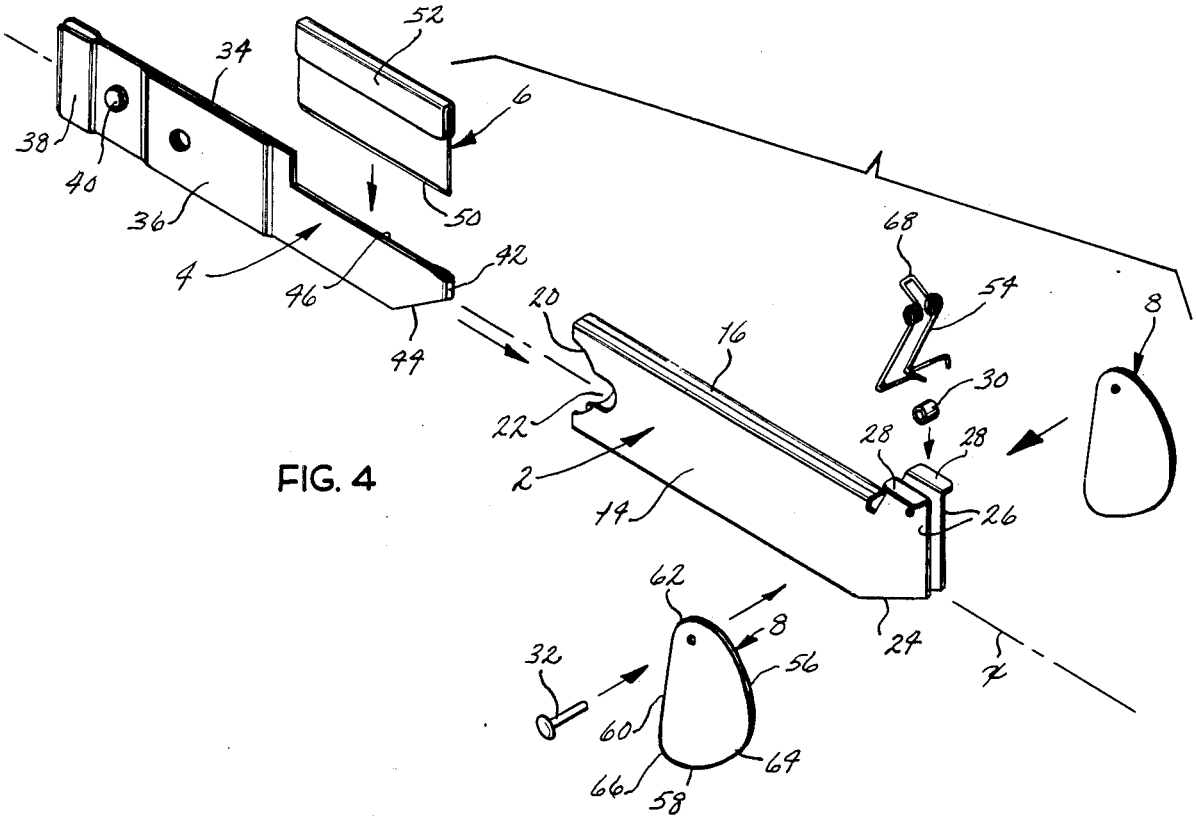
FIG. 4 is an exploded perspective view of the knife.
Figure 5:
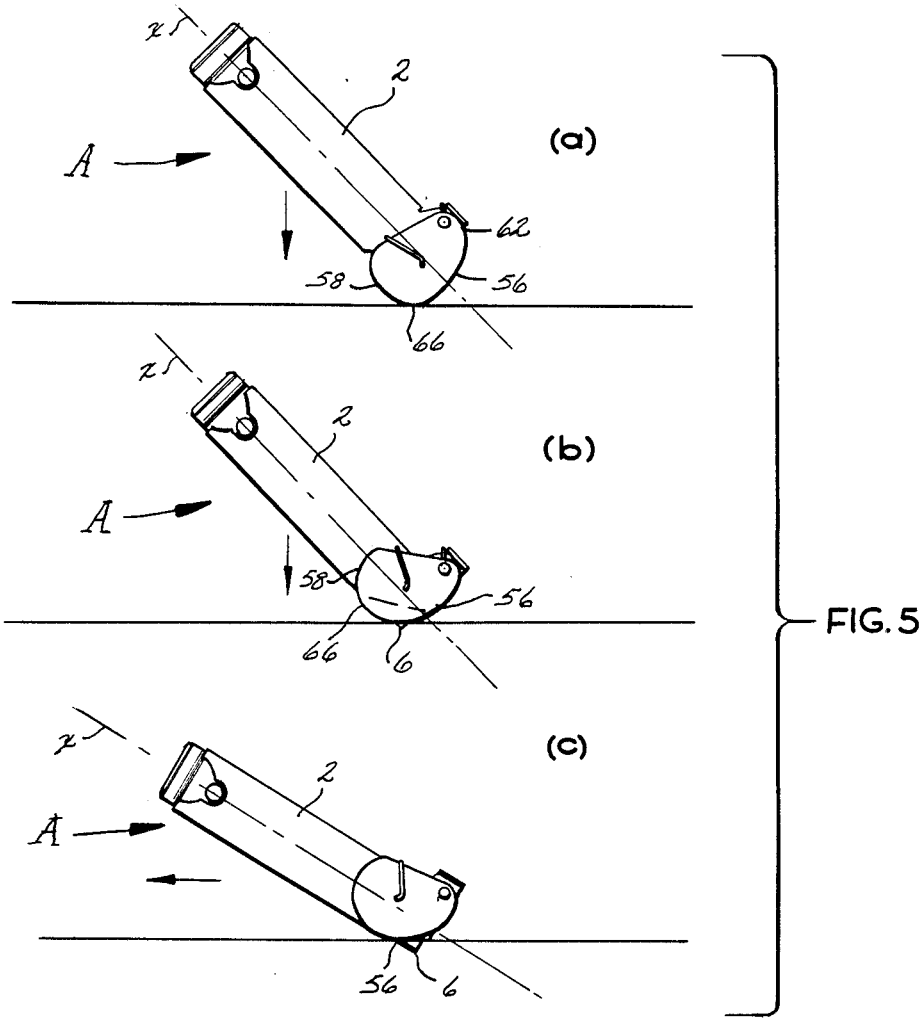
FIG. 5 is a sequential view showing the knife as it is brought against sheet material and then forced into the sheet material and finally drawn along the sheet material to create a slit.

The carrier 4 is actually a single strip of metal which is doubled back over upon itself to provide the two side walls 34 and 36 which are joined at a fold 42 (FIG. 4), and this fold, when the carrier 4 is fully inserted into the handle 2, is located along and in general registration with the front margins of the two side walls 12 and 14 on the handle 2 (FIG. 2). The fold 42 is relatively short inasmuch as the side walls 34 and 36 of the carrier 4 at the front end of the carrier 8 have oblique margins 44 which align with the oblique edges 24 on the handle 2 when the carrier 4 is fully inserted into the handle 2. While the oblique margins 44 are presented generally downwardly, the upper portions of the two side walls 34 and 36 are at the front of the carrier 4 cut away to provide a rectangular cutout 46 that opens upwardly and also forwardly above the fold 42 so as to accommodate the cutting blade 6.

In this regard, the blade 6 is a conventional cutting blade that is readily available at hardware stores, paint stores and the like, it being sold primarily for use in various knives and scrapers which are designed to accommodate it. More specifically, the blade 6 has a thin rectangular portion 48 (FIG. 4) which along one of its longer margins is ground to a sharp cutting edge 50. Along the opposite margin the rectangular portion 48 is fitted with a band 52 which folds over that margin and extends along both faces of the rectangular portion 48 parallel to the cutting edge 50, it being secured firmly to the rectangular portion 48. The band 52 is about the size of the rectangular cutout 46 in the carrier 4 and indeed fits within the rectangular cutout 46 when the blade 6 is properly inserted within the carrier 4. To insert the blade 6 into the carrier 4, the carrier 4 must first be withdrawn from the handle 2. Then the cutting edge 50 on the thin rectangular portion 48 of the blade 6 is aligned with the lower margin of the cutout 46 in the carrier 4 (FIG. 4) and then the rectangular portion 48 is forced between the two side walls 34 and 36 of carrier 4 until the band 52 of the blade 6 seats against the two margins of the cutout 46 (FIG. 2). When the blade 6 is so fitted, the band 52 completely fills the cutout 46 and in effect forms a continuation of the two walls 34 and 36 that constitute the carrier 4. Moreover, while most of the thin rectangular portion 48 for the blade 6 is captured between the two side walls 34 and 36 of the carrier 4, a triangular segment of the rectangular portion 48 projects beyond the oblique margins 44 at the front of the carrier 4, thus exposing the cutting edge 50 in this region. Indeed, the cutting edge 50, while being parallel to the lower edges of the carrier side walls 34 and 36 is set only slightly higher than those edges. The front or blade-carrying end of the carrier 4 is then aligned with the rear of the handle 2, and the carrier 4 is advanced through the handle 2 until the cylindrical boss 40 on its one side 36 seats within the smaller cutout 22 at the rear of the depressed wall 14 for the handle 2. Since the oblique margins 44 of the carrier 4 register with the oblique edges of the handle 2 when the carrier 4 is fully inserted, the triangular segment of the blade 6 which projects beyond the oblique margins 44 of the carrier 4 likewise project beyond the oblique edges of the handle 2, thereby exposing the cutting edge 50 generally as a continuation of the lower edge wall 18 for the handle 2 (FIG. 2). It is this segment of the blade 6 which is used for cutting purposes, and when the edge 50 along it becomes dull, the blade 6 may merely be reversed to expose the segment formerly clamped between the two carrier side walls 34 and 36. In any event, the blade 6 is held firmly in the handle 2 by reason of its thin rectangular portion 48 being clamped tightly between the side walls 34 and 36 of the carrier 4 and restrained at its leading end by the fold 42 and further by reason of its band 52 being captured between the margins of the cutout 46 and the overlying upper edge wall 16 of the handle 2. When the blade 6 is so positioned, its cutting edge 50 is parallel to the longitudinal axis x of the handle 2.

The two blade guards 8 are attached to the pivot tabs 26 at the single pivot pin 32 which extends through those tabs 26, there being a separate guard 8 beyond each of the handle side walls 12 and 14 (FIGS. 1 & 2). Moreover, each guard 8 is free to rotate on the pivot pin 32 through a limited arc of about 60°, with the limits of that rotation being established by the stop flanges 28 which project outwardly from tabs 26. Each guard 8 is urged to its forwardmost limit, that is to an extended position, by a spring 54 which winds around the pin 32 beyond each tab 26 and is further engaged with each of the guards 8. When the two blade guards 8 are so disposed, they are located to the sides of the exposed triangular segment of the blade 6 and further project below the cutting edge 50 so as to shield the blade 6 and thereby prevent its cutting edge 50 from presenting a hazard. On the other hand, when each guard 8 is moved rearwardly to the opposite end of its arc, that is to a fully retracted position, the guard 8 lies completely behind the oblique edges 24 of the handle 2 to expose the triangular segment of the blade 6.

The two blade guards 8 are identical in configuration and each possesses a somewhat triangular or, perhaps more accurately, a somewhat teardrop shape. In this regard, each guard 8 while being totally flat, has generally speaking three margins, namely a curved front margin 56 which is presented forwardly away from the front end of the handle 2, a curved lower margin 58 that is presented downwardly, and a generally straight rear margin that is presented rearwardly toward the rear of the handle 2, and in addition three corners which are discernible only by reason of their more pronounced curvature. Thus, the front and rear margins 56 and 60 merge at a top corner 62 which approximates being concentric to the axis of the pin 32; the front and lower margins 56 and 58 merge at a front corner 64 of somewhat greater radius, yet of a more pronounced curvature than either of the margins 56 and 58; while the lower and rear margins 58 and 60 merge at a rear corner 66 having a curvature that is in magnitude intermediate the curvatures of the corners 62 and 64.

When either guard 8 is in its forward or extended position (FIGS. 1 and 5*a*), that is the position in which it shields the blade 6, the curved upper corner 62 bears against the underside of the overlying flange 28 slightly ahead of the pin 26, and this of course keeps the guard 8 from swinging forwardly beyond its extended position under the force exerted by the spring 54. The curved front corner 64 is, on the other hand, presented immediately beyond the exposed forward end of the cutting edge 50 for the blade 6. Finally, the rear corner 66 is located slightly ahead and somewhat below the lower end of the oblique edge 24 at the front of the handle 2 so that a small segment of the cutting edge 50 is visible in the V-shaped gap that exists between the rear corner 66 and the lower end of the oblique edge 24. Finally, with respect to the lower edge wall 18 of the handle 2, the front corner 64 is somewhat higher than the rear corner 66 so that the curved lower margins 58 slopes slightly downwardly from the front corner 64 to the rear corner 66.

When either guard 8 is moved rearwardly to its fully retracted position, the rear margin 60 of the guard 8 bears against the underside of the flange 28 to the rear of the pivot pin 32 generally at or close to the somewhat indistinct location where the rear margin 60 transforms into the upper corner 62. Moreover, the curved front margin 56 of the guard 8 is located slightly above and behind the oblique edges of the handle 2, whereas the curved front corner 64 is above the lower edge wall 18 on the handle 2. Of course, when the guard 8 is in this position, a triangular segment of the rectangular portion 48 for the blade is exposed as is the cutting edge 50 along the bottom of the exposed segment.

The spring 54 exerts its biasing force on each of the guards 8, yet allows the guards 8 to move independently of each other. In this regard, the spring 54 has two sections—one for each guard 8—and these sections are connected at a cross piece 68 which is located behind the pivot tabs 26 and beneath the flanges 28 and further spans the gap between the two tabs 26. Each section is for the most part located in the space between the guard 8 that it biases and the handle side wall 12 or 14 opposite which that guard is located, and in this space the spring 54 extends forwardly from its cross piece 68, wraps around the pivot pin 32, then extends downwardly and rearwardly to the rear margin 60 of the guard 8, thence outwardly across the rear margin 60, and finally forwardly over the outwardly presented face of the guard 8 where it terminates approximately midway between the curved front and rear margins 56 and 60.

When the box knife A is not in use, the guards 8 assume their forward or extended positions (FIGS. 1, 2 & 5*a*), because the spring 54 urges each of the guards 8 forwardly to the extent that the upper corner 62 of each is slightly ahead of the pivot pin 32 and bears against the underside of the stop flange 28 which overlies that corner. In their forward or extended positions, the guards 8 effectively shield the triangular segment of the knife blade 6 which projects beyond the handle 2, for the guards 8 are located to the sides of the blade segment with their front margins 56 ahead of the segment and their lower margins 58 below the segment. In short, that segment of the blade 6 which projects beyond the handle 2 is in its interposed between the two guards 8 so that the cutting edge 50 that is along it is shielded and does not present a hazard.

To use the knife A for slitting corrugated paperboard or some other sheet material, the knife A is grasped along its handle 2 and moved toward the sheet material with the axis x of the handle 2 presented at an angle of perhaps 30° to 60° with respect to the surface of the sheet material (FIG. 5*a*). The orientation of the knife A should be such that the knife A first contacts the sheet material along the front corners 64 of its guards 8. Thus, as the knife A continues to advance, the guards 8 tend to roll along the surface of the sheet material and retract. After a short distance, the sharp corner of the forwardly projecting segment of the knife blade 6 encounters the sheet material and pierces it (FIG. 5*b*). The cutting edge 50 thereupon cuts into the sheet material, entering that material to the full extent of the projection of the blade 6 beyond the handle 2. As it does, the guards 8 at their curved front corners 66 and curved front margins 56, merely roll along the sheet material and thus pivot toward their retracted positions. In short, the blade 2 is forced into the sheet material until the oblique edges 24 at the front end of the handle 2 come against the surface of the sheet material (FIG. 5*c*). In this condition, the curved front margins 56 of the two guards 8 are against the surface of the sheet material. Once the blade 6 is fully inserted, the knife A is drawn along the sheet material at approximately the same angle or perhaps at a somewhat lesser angle, that is with the axis x at an angle of about 30° to 60° with respect to the surface, and of course as the knife A moves, its cutting edge slits the sheet material. The front margins 56 of the guards 8 remain against the surface of the sheet material by reason of the bias exerted by the spring 54, and these margins merely slide along that surface as cutting edge 5 slits the material.

If the knife A is withdrawn from the slit that is formed by the blade 6, the guards 8 spring forwardly and again conceal the forwardly projecting portion of the blade 6 so as to shield the cutting edge 50. Similarly, if the slit extends all the way to the edge of the sheet material, allowing the knife blade 6 to pass out of the sheet material as at the corner of a corrugated paperboard box, the guards 8 will immediately spring forwardly and shield the blade 6 so that blade 6 does not harm the user or someone nearby. In this regard, it must be recognized that the sheet material does exert a considerable amount of resistance on the knife blade 6 and accordingly the knife A must be drawn with a considerable amount of force. Once this resistance is released, as when the blade 6 passes beyond the edge of the sheet material, the force, unless restrained, will propel the knife A in a condition of lesser control. Since the guards 8 immediately snap forwardly once the blade 6 passes beyond the slit, the chances of injuring someone are diminished significantly.

Figure 6:
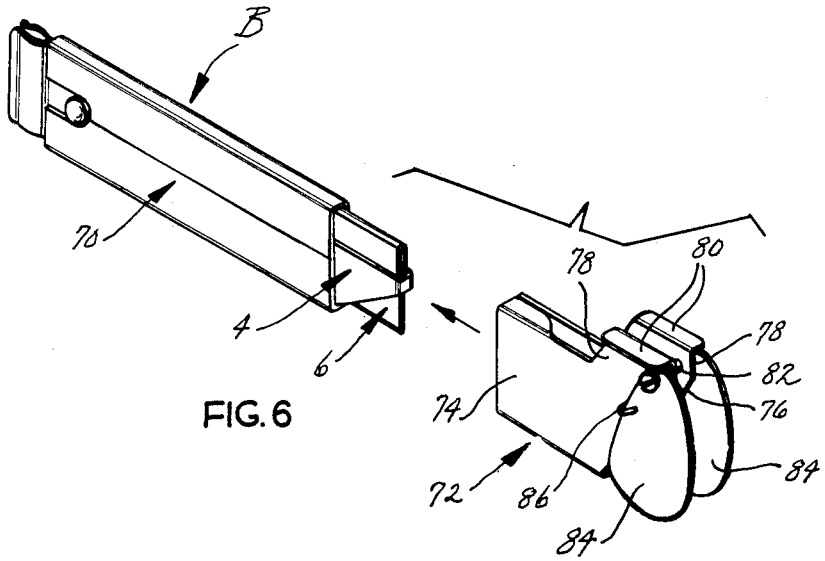
FIG. 6 is a perspective view showing the conventional box knife provided with a protective device constructed in accordance with the present invention, but the protective device being illustrated detached from the conventional knife.

The safety features of the present invention may likewise be incorporated into a conventional box knife B (FIG. 6) of the type often referred to as a Jiffi Cutter knife. The conventional knife B includes a blade carrier 4 and blade 6 and in addition a tubular handle 70 which has squared off front and rear edges and is short enough to enable the oblique margins 44 of the blade carrier 4 and the segment of the blade 6 which extends beyond those margins to be exposed when the carrier 4 is fully inserted into the handle 70. Irrespective of whether the knife B is in use or not, the sharp cutting edge 50 of the blade 6 is exposed beyond the handle 70 and thus presents a very real danger, unless the carrier 4 and blade 6 are retracted into the handle 70. This requires a conscious effort which most users are unwilling to undertake.

To improve the safety of the knife B, a protective device 72 is fitted to its handle 70 and this device includes a sleeve 74 which fits snugly over the forward end of the handle 70 and for all intents and purposes constitutes part of the handle 70. The sleeve 74 has oblique leading edges 76, pivot tabs 78, and flanges 80 which correspond respectively to the oblique edges 24, pivot tabs 76 and flanges 28 of the handle 2. Moreover, the pivot tabs 78 have a cross pin 82 extended through them, with guards 84 being mounted on the pin 82 at its ends. The guards 84 are the same shape as the guards 8 and function in the same manner. As such they are urged forwardly by a spring 86.

This invention is intended to cover all changes and modifications of the example of the invention herein chosen for purposes of the disclosure which do not constitute departures from the spirit and scope of the invention.

What is claimed is:

1. A knife comprising: a handle having front and rear ends; a blade having a cutting edge; means on the handle for positioning the blade such that at least a segment of the blade and its cutting edge projects beyond the front end of the handle; and guards mounted on the handle at the front end of the handle along both sides of the blade, and being movable between a forward extended position and rear retracted position, the guards being biased forwardly toward the extended position but being prevented from moving forwardly beyond the extended position, the guards when in the extended position being located to the sides of the segment of the blade that projects beyond the front end of the handle and further projecting beyond the cutting edge on the segment of the blade that projects beyond the handle, whereby the blade and its cutting edge are normally shielded when the knife is not in use, the guards when in their retracted position being located rearwardly on the handle from the position they assume when in the extended position and permitting the projecting segment of the blade and its cutting edge to be exposed for cutting purposes.

2. A knife according to claim 1 wherein the guards pivot between their extended and retracted positions about an axis that is offset from the cutting edge of the blade.

3. A knife according to claim 1 wherein the axis about which the guards pivot is fixed in position with respect to the handle.

4. A knife according to claim 2 wherein the guards are somewhat triangular in shape in that they have generally three corners, and the pivot axis is at one of the corners.

5. A knife according to claim 4 wherein the corners of each guard are curved.

6. A knife according to claim 4 wherein the three corners on each guard include an upper corner at which the pivot axis is located, a front corner which is located generally directly beyond the end of the cutting edge when the guard is in its extended position, and a rear corner which, when the guard is in its extended position, is located near that end of the handle from which the blade projects.

7. A knife according to claim 6 wherein the front corner of each guard is curved.

8. A knife according to claim 7 wherein each guard also has margins located between its corners, there being a front margin between the upper corner and the front corner, a lower margin between the front corner and the rear corner, and a rear margin between the rear corner and the upper corner, and wherein the front margin is curved with the curvature of that margin being less than the curvature of the front corner and with the front margin merging into the front corner.

9. A knife according to claim 8 wherein the curvature of the front margin is convex.

10. A knife according to claim 9 wherein the lower margin is also curved with its curvature being convex.

11. A knife according to claim 2 and further comprising at least one spring for urging the guards to their extended positions and stops on the handle for preventing the spring form urging the guards beyond their extended positions.

12. A knife according to claim 11 wherein each guard when in its extended position contacts one of the stops.

13. A knife according to claim 4 wherein the handle is hollow and the means for positioning the blade includes a blade carrier which fits into the handle and holds the blade.

14. A knife according to claim 2 wherein the leading edge of each guard is curved convexly generally about the axis on which the guards pivot, so that when the knife is brought against a surface to be cut, the guards will roll along the surface toward their retracted position to enable the blade to penetrate the surface.

15. A knife comprising a handle having sides, upper and lower surfaces extending between the sides, and front and rear ends; a flat blade mounted within the handle such that a segment of the blade projects from the front end of the handle, the segment having a cutting edge which is located generally beyond the lower surface of the handle, whereby the knife may be grasped at its handle, and with the handle leading, its blade may be drawn through an object to be slit; guards mounted on the handle to pivot about an axis that is located above the cutting edge and is perpendicular to the plane of the blade, there being one guard on one side of the blade and another on the other side, the guards being rotatable about the pivot axis between an extended position wherein the projecting segment of the blade is shielded and a retracted position wherein the projecting segment is exposed for cutting purposes, the extended position for the guards being located ahead of the retracted position relative to the handle, so that the guards in moving from their extended to their retracted positions pivot rearwardly with respect to the handle, the guards having curved edges which are presented away from the pivot axis and are in the region of the cutting edge when the guards are extended, the curved edges being configured to roll along a surface of the object to be slit and to thereby cause the guards to move to their retracted position as the blade penetrates the surface under a force exerted on the handle; and means on the handle for preventing the guards from pivoting forwardly beyond the extended position.

16. A knife according to claim 15 wherein the handle has a longitudinal axis that is located generally midway between its upper and lower surfaces and wherein the cutting edge of the blade is generally parallel to the longitudinal axis, and the pivot axis is located above the longitudinal axis.

17. A knife according to claim 15 wherein the pivot axis is located in the region of the upper surface of the handle.

18. A knife according to claim 17 wherein the cutting edge generally constitutes a continuation of the lower surface of the handle.

19. A knife comprising: a handle having ends; a blade having a cutting edge; means on the handle for positioning the blade such that at least a segment of the blade and its cutting edge projects beyond one end of the handle; and guards mounted on the handle at both sides of the blade, and being rotatable about an axis that is offset from the cutting edge of the blade so as to move between extended and retracted positions, but being biased toward the extended position, the guards when in the extended position being located to the sides of the segment of the blade that projects beyond the end of the handle and further projecting beyond the cutting edge on the segment of the blade that projects beyond the handle, whereby the blade and its cutting edge are normally shielded when the knife is not in use, the guards when in their retracted position permitting the projecting segment of the blade and its cutting edge to be exposed for cutting purposes, each guard being somewhat triangular in shape in that it has generally three corners, including an upper corner at which the pivot axis is located, a curved front corner which is located generally directly beyond the end of the cutting edge when the guard is in its extended position, and a rear corner which, when the guard is in its extended position, is located near that end of the handle from which the blade projects, there also being on each guard margins located between the corners, including a convex front margin between the upper corner and the front corner, a convex lower margin between the front corner and the rear corner, and a rear margin between the rear corner and the upper corner, the front margin being curved with the cruvature of that margin being less than the curvature of the front corner and with the front margin merging into the front corner.

* * * * *